US011825568B2

(12) United States Patent
Khizar et al.

(10) Patent No.: US 11,825,568 B2
(45) Date of Patent: Nov. 21, 2023

(54) SEGMENTED THERMORESISTIVE HEATING SYSTEM

(71) Applicant: WHIRLPOOL CORPORATION, Benton Harbor, MI (US)

(72) Inventors: Muhammad Khizar, St. Joseph, MI (US); Ermanno Buzzi, Varese (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 288 days.

(21) Appl. No.: 17/220,381

(22) Filed: Apr. 1, 2021

(65) Prior Publication Data

US 2022/0322497 A1 Oct. 6, 2022

(51) Int. Cl.

| | |
|---|---|
| ***H05B 3/28*** | (2006.01) |
| ***H05B 3/74*** | (2006.01) |
| ***F24C 7/06*** | (2006.01) |
| ***F24C 7/08*** | (2006.01) |

(52) U.S. Cl.

CPC ..... *H05B 3/283* (2013.01); *F24C 7/067* (2013.01); *F24C 7/087* (2013.01); *H05B 3/748* (2013.01); *H05B 2203/005* (2013.01); *H05B 2203/013* (2013.01); *H05B 2214/04* (2013.01)

(58) Field of Classification Search

CPC ..... H05B 3/145; H05B 3/748; H05B 3/283; H05B 3/74; H05B 2214/04; H05B 2203/005; H05B 2203/013; F24C 7/087; F24C 7/067

USPC ..... 219/466.1

See application file for complete search history.

(56) References Cited

U.S. PATENT DOCUMENTS 3,883,719 A * 5/1975 Hurko ..... H05B 3/748 338/217
3,895,216 A * 7/1975 Hurko ..... F24C 15/104 219/466.1
3,978,315 A * 8/1976 Martin ..... H05B 3/265 427/125

(Continued)

FOREIGN PATENT DOCUMENTS

DE 100 01 330 A1 7/2001
DE 10 2009 027172 A1 12/2010

(Continued)

OTHER PUBLICATIONS

European Search Report for EP 22165168 dated Sep. 23, 2022, 8 pages.

*Primary Examiner* — Eric S Stapleton
(74) *Attorney, Agent, or Firm* — Brooks Kushman P.C.

(57) ABSTRACT

An electric cooking appliance includes a glass-ceramic substrate having a top surface for supporting cookware for heating thereon, and a bottom surface opposite the top surface. The electric cooking appliance includes a plurality of thermoresistive heating elements disposed and spaced apart on the bottom surface of the glass-ceramic substrate, with each of the plurality of thermoresistive heating elements including graphene nanoparticles embedded in a ceramic matrix for generating heat upon application of electric current to the respective thermoresistive heating element. Each thermoresistive heating element is electrically connected to a power supply such that one or more of the plurality of thermoresistive heating elements are selectively activated to receive electric current to heat localized areas of the glass-ceramic substrate.

18 Claims, 2 Drawing Sheets

(56) References Cited

U.S. PATENT DOCUMENTS 3,978,316 A * 8/1976 Rose ..... H05B 3/265 427/125
4,973,826 A * 11/1990 Baudry ..... H05B 3/748 219/466.1
4,997,698 A * 3/1991 Oboodi ..... C03C 8/02 428/209
5,198,885 A * 3/1993 Ibrahim ..... H01L 23/04 361/717
5,973,298 A * 10/1999 Kallgren ..... H05B 3/748 219/465.1
7,265,323 B2 * 9/2007 Gerhardinger .... B32B 17/10376 219/541
8,168,925 B2 * 5/2012 Demol ..... F24C 7/083 219/460.1
9,327,969 B2 * 5/2016 Shah ..... H01P 3/12
9,657,415 B2 * 5/2017 Zhamu ..... D01F 9/12
10,037,117 B2 * 7/2018 Zenker ..... G06F 3/0443
10,209,838 B2 * 2/2019 Gabriel ..... F24C 7/086
10,480,099 B2 * 11/2019 Zhamu ..... D01D 10/06
10,598,388 B2 * 3/2020 Alexander ..... F24C 7/086
2003/0189829 A1 * 10/2003 Shimizu ..... F21V 29/70 362/240
2004/0108307 A1 * 6/2004 Gadow ..... H05B 3/748 219/468.1
2004/0164067 A1 * 8/2004 Badami ..... H05B 3/746 219/448.11
2007/0246450 A1 * 10/2007 Cady ..... H01L 21/67121 438/455
2007/0249098 A1 * 10/2007 Cady ..... H01L 21/67121 438/455
2012/0074127 A1 * 3/2012 Abbott ..... H05B 6/1272 219/486
2012/0118873 A1 * 5/2012 Erismis ..... H05B 3/265 29/611
2014/0097917 A1 * 4/2014 Shah ..... H01P 3/06 977/932
2014/0175707 A1 * 6/2014 Wolk ..... G03F 7/0002 264/293
2014/0178646 A1 * 6/2014 Wolk ..... C03C 17/28 428/161
2014/0242343 A1 * 8/2014 Free ..... B32B 27/34 156/60
2015/0038041 A1 * 2/2015 Zhamu ..... D03D 15/00 210/500.1
2015/0305094 A1 * 10/2015 Everett, Jr. ..... H05B 3/68 219/432
2017/0031480 A1 * 2/2017 Gabriel ..... F24C 7/086
2017/0150552 A1 * 5/2017 Erismis ..... H05B 3/0014
2017/0160835 A1 * 6/2017 Zenker ..... F24C 7/086
2017/0211208 A1 * 7/2017 Zhamu ..... D03D 15/46
2017/0225233 A1 * 8/2017 Zhamu ..... B22F 1/102
2019/0170363 A1 * 6/2019 Shen ..... A62C 3/006
2020/0063971 A1 * 2/2020 Song ..... H05B 3/20
2020/0168356 A1 * 5/2020 Lin ..... H01B 13/0016
2020/0248059 A1 * 8/2020 Miller ..... C03C 8/14

FOREIGN PATENT DOCUMENTS

DE 102014106006 A1 11/2014
FR 3068117 B1 11/2019
WO 2019/064123 A1 4/2019

* cited by examiner

SEGMENTED THERMORESISTIVE HEATING SYSTEM

TECHNICAL FIELD

The present application is directed to heating elements for a cooking appliance, and more particularly, heating elements with a thermoresistive nanoparticle layer for a cooking appliance.

BACKGROUND

Conventional electric cooking appliances, such as radiant and non-radiant electric stoves and cook-tops, include a cook-top surface. At least one cooking area is defined on the cook-top surface. A heating element is disposed underneath the cook-top surface for providing heat to cookware positioned on the at least one cooking area. Each cooking area is connected to a control allowing a user to control the heat emitted from the heating element. The level heat that is provided is controlled by adjusting the power supplied to the heating element for the cooking area being controlled. The heating elements of conventional radiant and non-radiant electric cooktops require high energy consumption due to the steel rod and copper wires used as the heating elements. In addition to having high power consumption rates, rod-type heading elements may result in dissipative heat loss and glass-ceramic surface corrosion over time.

SUMMARY

According to one or more embodiments, an electric cooking appliance, includes a glass-ceramic substrate having a top surface for supporting cookware for heating thereon, and a bottom surface opposite the top surface. The electric cooking appliance also includes a plurality of thermoresistive heating elements disposed and spaced apart on the bottom surface of the glass-ceramic substrate, each of the plurality of thermoresistive heating elements including graphene nanoparticles embedded in a ceramic matrix for generating heat upon application of electric current to the respective thermoresistive heating element. Each thermoresistive heating element is electrically connected to a power supply such that one or more of the plurality of thermoresistive heating elements are selectively activated to receive electric current to heat localized areas of the glass-ceramic substrate.

In at least one embodiment, two or more of the plurality of thermoresistive heating elements may be interconnected and connected to the power supply such that predefined groups of thermoresistive heating elements of the plurality of heating elements may be selectively activated to receive the electric current. In one or more embodiments, the electric cooking appliance may further include electrically insulative material positioned between adjacent heating elements of the plurality of thermoresistive heating elements, with the electrically insulative material having a thermal conductivity of 0.015 W/mK to 0.5 W/mK. In certain embodiments, each of the thermoresistive heating elements may be a hybrid material further including Ag, Ni, or Ga nanoparticles, or combinations thereof. In at least one embodiment, the ceramic matrix may be a blend of zirconia and one or more of an epoxy and a polyurethane. According to one or more embodiments, each of the thermoresistive heating elements may have a thickness of 100 μm to 2 mm. In one or more embodiments, each thermoresistive heating element may include a thermoresistive film layer with the graphene nanoparticles, with the thermoresistive film layer having a thickness of 15 nm to 1.75 mm. In certain embodiments, the graphene nanoparticles have an average particle size of 2.5 nm to 50 nm. In at least one embodiment, each of the thermoresistive heating elements may include a protective ceramic layer on an opposite side of the plurality of thermoresistive heating elements from the glass-ceramic substrate, with the protective ceramic layer having a thickness of 0.1 to 0.5 mm.

According to one or more embodiments, an electric cooking appliance includes a glass-ceramic substrate having a top surface for supporting cookware for heating thereon, and a bottom surface opposite the top surface. The electric cooking appliance also includes a plurality of thermoresistive heating elements disposed and spaced apart on the bottom surface of the glass-ceramic substrate, each of the plurality of thermoresistive heating elements including a thermoresistive layer of hybrid silver-graphene nanoplatelets in a ceramic matrix in contact with the bottom surface. Each thermoresistive heating element is electrically connected to at least one of another thermoresistive heating element and a power supply such that one or more of the plurality of thermoresistive heating elements are selectively activated to receive electric current to heat localized areas of the glass-ceramic substrate.

In at least one embodiment, each of the thermoresistive heating elements may include a corresponding pair of silver electrodes for arrangement with electrical wiring to electrically connect the thermoresistive heating elements. In one or more embodiments, the ceramic matrix may be a blend of zirconia and an epoxy. In certain embodiments, each thermoresistive heating element may be independently activatable for selective activation to form a customized cooking area. In at least one embodiment, each of the plurality of thermoresistive heating elements may be a layered composite including a protective ceramic layer on an opposite side of the thermoresistive layer from the glass-ceramic substrate. In further embodiments, each of the thermoresistive heating elements may include a corresponding pair of silver electrodes on opposite sides of the respective heating element in contact with the bottom surface, and the silver electrodes may include an electrically insulative material thereon on a side of each electrode opposite from the bottom surface. In certain further embodiments, the electrically insulative material and the protective ceramic layer may be the same material.

According to one or more embodiments, an electric cooking appliance includes a glass-ceramic substrate having a top surface for supporting cookware for heating thereon, and a bottom surface opposite the top surface. The electric cooking appliance also includes a plurality of thermoresistive heating elements disposed and spaced apart on the bottom surface of the glass-ceramic substrate, each of the plurality of thermoresistive heating elements including graphene nanoparticles embedded in a ceramic matrix for generating heat upon application of electric current to the respective thermoresistive heating element; and an electrically insulative layer positioned between adjacent thermoresistive heating elements of the plurality of thermoresistive heating elements and on an opposite side of the plurality of thermoresistive heating elements from the glass-ceramic substrate. Each thermoresistive heating element is electrically connected to at least one of another thermoresistive heating element and a power supply such that one or more of the plurality of thermoresistive heating elements are selectively activated to receive electric current to heat localized areas of the glass-ceramic substrate.

In at least one embodiment, each of the plurality of thermoresistive heating elements may include a protective ceramic layer on a surface of the respective thermoresistive heating element opposite from the glass-ceramic substrate. In certain embodiments, each of the plurality of thermoresistive heating elements may further include nanoparticles of Ag, Ni, Ga, or combinations thereof in the ceramic matrix. In further embodiments, the nanoparticles of Ag, Ni, Ga, or combinations thereof are loaded into the ceramic matrix by 0.25 to 2% loading by weight.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Moreover, except where otherwise expressly indicated, all numerical quantities in this disclosure are to be understood as modified by the word "about". Practice within the numerical limits stated is generally preferred. Also, unless expressly stated to the contrary, the description of a group or class of materials by suitable or preferred for a given purpose in connection with the disclosure implies that mixtures of any two or more members of the group or class may be equally suitable or preferred.

According to one or more embodiments, a cooking appliance, such as an electric cooktop (e.g., a radiant or non-radiant electric cooktop), includes a plurality of interconnected heating elements beneath a glass-ceramic cooktop surface. These heating elements define a plurality of heating areas on the top surface of the glass-ceramic cooktop. The interconnected heating elements have a layered structure of film layers (e.g., thin film layers), which is applied to the bottom surface of the glass-ceramic cooktop. The film layers include a thermosensitive coating layer including graphene nanoparticles blended in a ceramic to provide thermal diffusion with less power consumption than conventional rod-type heating elements. Independent heating elements may be selectively activated to increase the heating capability within a particular cooking area of the cooktop, thus forming a conformal heating profile over a larger area using a network of connected heating elements.

Figure 1:
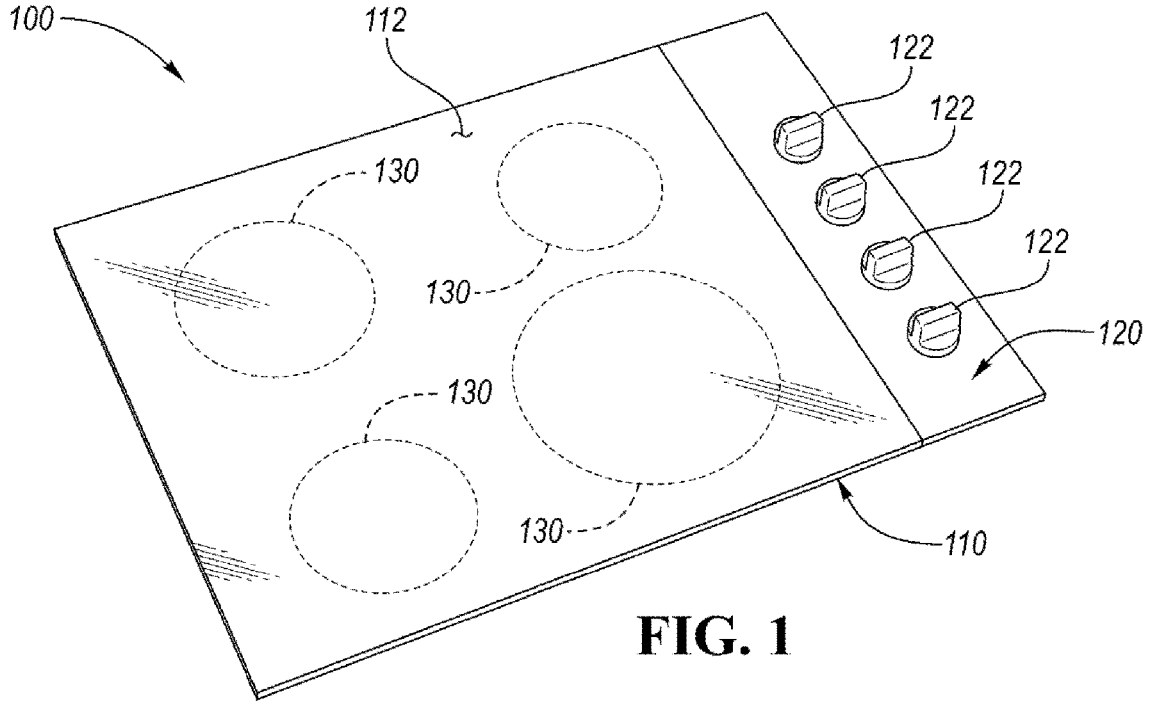
FIG. 1 is a schematic top view of an electric cooking appliance, according to an embodiment.
Figure 2:
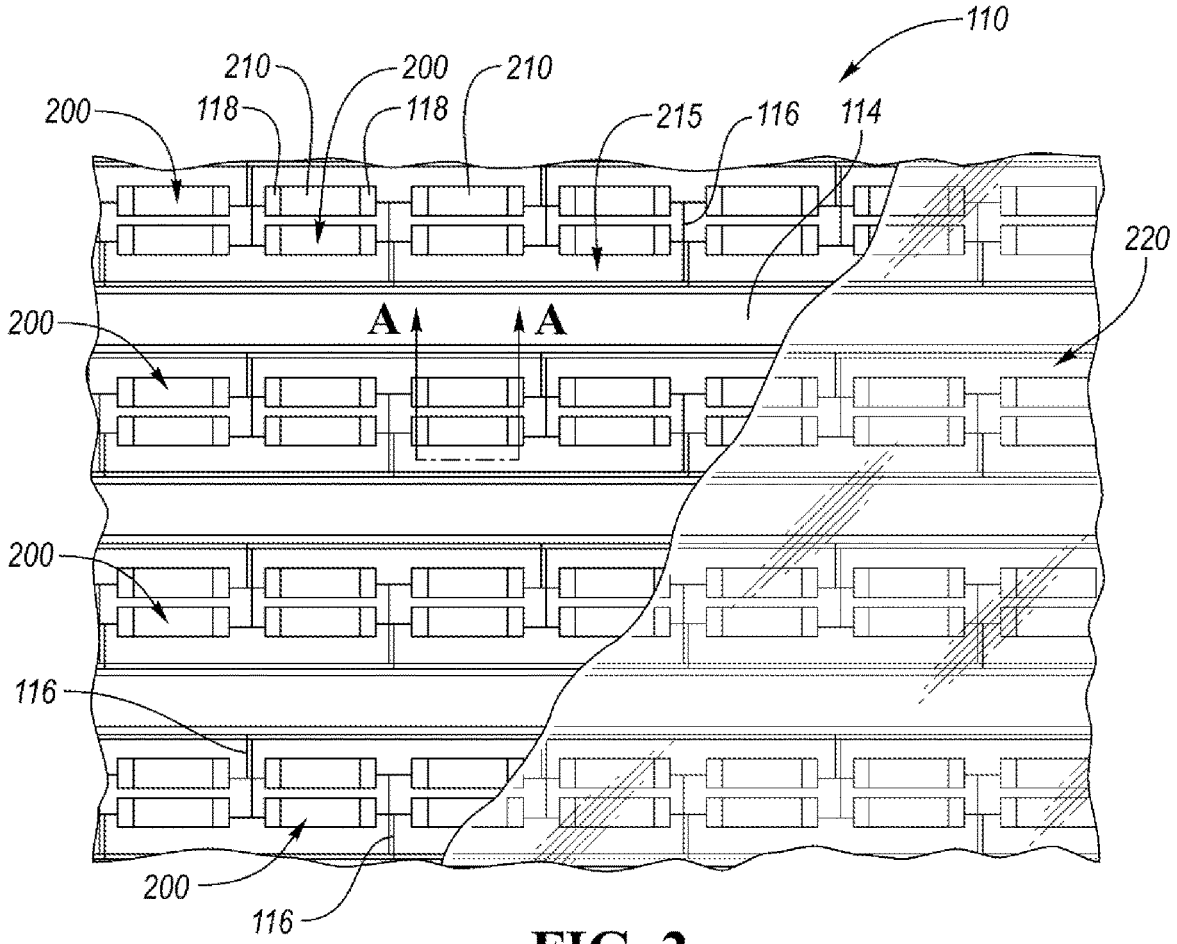
FIG. 2 is a schematic bottom view of the electric cooking appliance of FIG. 1.

Referring to FIGS. 1-2, a cooking appliance 100 is shown, according to an embodiment. The cooking appliance 100 may be an electric stove or cooktop in many examples. The cooking appliance 100 includes a glass-ceramic substrate 110 (hereinafter, interchangeably a ceramic substrate 110) having a top surface 112 for receiving cookware thereon for heating. The glass-ceramic substrate 110 includes a bottom surface 114, opposite of the top surface 112, on the underside of the glass-ceramic substrate.

The glass-ceramic substrate 110 is a glass-ceramic material having a thermal conductivity of at least 3.0 mW/cm for transferring heat to the cookware. In certain embodiments, the glass-ceramic material has a thermal conductivity of 3.0 to 10.0 mW/cm, in other embodiments 3.1 to 9.9 mW/cm, and in yet other embodiments 3.5 to 9.5 mW/cm. The glass-ceramic material may be any suitable material, including, but not limited to compositions having MgO crystal, or glass matrices like $La_2O_3$—$B_2O_3$—$SiO_2$—MgO. The glass-ceramic substrate 110 may have any suitable thickness for transferring heat to and support the cookware articles, and in some embodiments, may have a thickness of 2.5 to 8.5 mm, in other embodiments 3 to 8 mm, and in yet other embodiments 3.5 to 7 mm. In certain examples, the glass-ceramic substrate 110 may be 4 mm or 6 mm thick.

The cooking appliance 100 further includes a control panel 120 for controlling cooking area(s) 130 on the top surface 112 of the glass-ceramic substrate 110. Although shown as integrated with the surface of the ceramic substrate 110, the control panel 120 may in other embodiments be separate from the glass-ceramic substrate 110. Furthermore, although shown as a control panel 120 with control knobs 122, the control panel 120 may include any suitable mechanism for activating and controlling the cooking areas, including, but not limited to, a digital control panel, push buttons, etc. The control panel 120 is connected to a power supply (not shown), such as a wall outlet, for electronically powering the cooking appliance 100.

Referring to FIG. 2, the bottom surface 114 of the glass-ceramic substrate 110 includes a plurality of heating elements 200 in contact with the bottom surface 114. Each of the plurality of heating elements 200 is a thermo-resistive element which generates heat upon application of current to the heating element 200. Details of the heating elements 200 will be discussed with reference to FIGS. 3-4.

The heating elements 200 are electrically connected to the power supply via the control panel 120. In certain embodiments, each heating element 200 may be independently connected to the control panel 120 for selective activation by supply of electrical power to the heating elements 200, or, in other embodiments, may be connected to other heating elements 200 for selective activation of connected heating elements 200. In one example, the heating elements 200 may be independently selectively activatable based on user input at the control panel 120 for to form a customizable desired cooking area size for the cooking appliance 100, and in other examples certain groups of heating elements 200 may correspond to a particular predefined heating areas (such as cooking areas 130) activatable by user input at the control panel 120. The predefined heating areas in certain embodiments, may further be variable in size via selective activation of one or more groups of heating elements 200. As such, the heating elements 200 may be independently activatable or be activatable in groups of one or more heating elements 200 to form the cooking areas 130, and thus may each be connected to the power supply (via the control panel 120) for independent activation, or interconnected to other heating elements 200. In embodiments where the heating elements are interconnected, for selective activation of heating elements or groups of heating elements, the electrical connections between heating elements 200 may be selectively interruptible to allow customization of the cooking area size and shape by the user at the control panel 120.

Thus, the selective activation of one or more of the heating elements 200 together can form cooking areas 130 of varying shape and size, as based on the size of the cookware being used for example. As such, cooking areas 130, although shown as round in FIG. 1, may be any suitable shape, or may not be constrained to a particular shape as based on combinations of activated heating elements 200. Thus, in certain embodiments, predefined groups of heating elements 200 are electrically connected to the control panel 120 for activation as a predefined group (e.g., a cooking area 130) or predefined groups (e.g., cooking area 130 with additional groups to increase size), or, in other embodiments, may be independently selectively activatable by user input to form customized heating areas of varying shape and size as based on various considerations such as for example, the desired article to be heated. Heat from the heating element 200 (or the network of heating elements 200) is conductively transferred through the glass-ceramic substrate 110 to the cookware placed on the top surface 112 at the cooking areas 130 upon selective activation of the heating elements 200 corresponding to the cooking area 130.

The heating elements 200 may be electrically connected in any suitable manner (shown as electrical connection 116 in FIG. 2), such as, but not limited to, by copper connectors or other wiring, buses, or interconnects to flow current between heating elements 200 to produce heat. Each heating element 200 may also include an electrode 118, or pair of electrodes 118, for applying the electrical conduction uniformly to the heating element 200. In one or more embodiments, the electrodes 118 are positioned on opposite sides of the respective heating element 200 to allow current to flow through the heating element 200 from one of the electrodes 118 to the other electrode 118, such that heat is generated in the heating element 200. In certain embodiments, the electrode 118 may be silver.

Each heating element 200 may have any suitable size and/or shape, as based on the desired cooking area shapes in the glass-ceramic substrate 110. As shown in FIG. 2, each heating element 200 may have a square shape. However, the depiction of a square heating element 200 is not intended to be limiting, and other shapes, such as, but not limited to, circles, triangles, hexagons, or other polygons, are also contemplated such that the cooking areas 130 of varying shape and overall size can be created from groups of heating elements 200.

Each heating element 200 may have a dimension (e.g., length or width) sized to be, in some embodiments, 250 to 525 mm, in other embodiments, 275 to 500 mm, and in yet other embodiments, 300 to 475 mm. Regardless of shape, the area of an individual heating element 200 may range from up to 100,000 $mm^2$ in some embodiments, to 100,000 to 250,000 $mm^2$ in certain embodiments, 110,000 to 200,000 $mm^2$ in other embodiments, and 125,000 to 175,000 $mm^2$ in yet other embodiments. Furthermore, the overall thickness of the heating element 200 is smaller than conventional heating elements, thus resulting in a less robust construction for the cooking appliance 100 due to the thermoresistive layer composition including nanoparticles to form the thermoresistive heating element 200, as will be discussed with respect to FIGS. 3-4. The thickness of the heating element 200 may be, in some embodiments, 100 μm to 2 mm, in other embodiments, 125 μm to 1.5 mm, and in yet other embodiments 150 μm to 1 mm. As such, the layers of the heating element 200 and the glass-ceramic substrate 110 collectively may together have an overall thickness, in certain embodiments, of 4 to 8 mm, in other embodiments of 4.2 to 7.5 mm, and in yet other embodiments 4.8 to 6.8 mm.

Generally, each heating element 200 generates heat upon application of electric current through the heating element 200. When electric power is applied to the heating elements 200, the free charge carriers flow through active ingredients in the heating element 200, such as, but not limited to graphene nanoparticles or carbon nanotubes (CNTs) (or combinations thereof) supported in a suitable matrix (e.g., ceramic matrix). Additionally, polymeric materials may be used as a blending agent for the active materials (e.g., polyurethane), which offer resistance to the flow of charge carriers through the heating element 200 thus facilitating heat generation. As a result of this resistance in the heating element 200, free charge carriers impart their energy in the form of heat in the applied coating, ultimately this heat is transferred into the glass-ceramic substrate 110.

Each heating element 200 may independently have any suitable resistance based on its composition for the desired heat generation as based on the size and location of the plurality of heating elements 200. In some embodiments, each heating element 200 may have a resistance of 10 to 50 Ω, in other embodiments, 1.0 to 35 Ω, and in yet other embodiments, 20 to 30 Ω In certain embodiments, combining heating elements 200 of similar resistance results in a higher temperature observed at the top surface 112 based on the current applied (e.g., the surface where articles are placed to be heated).

Figure 3:
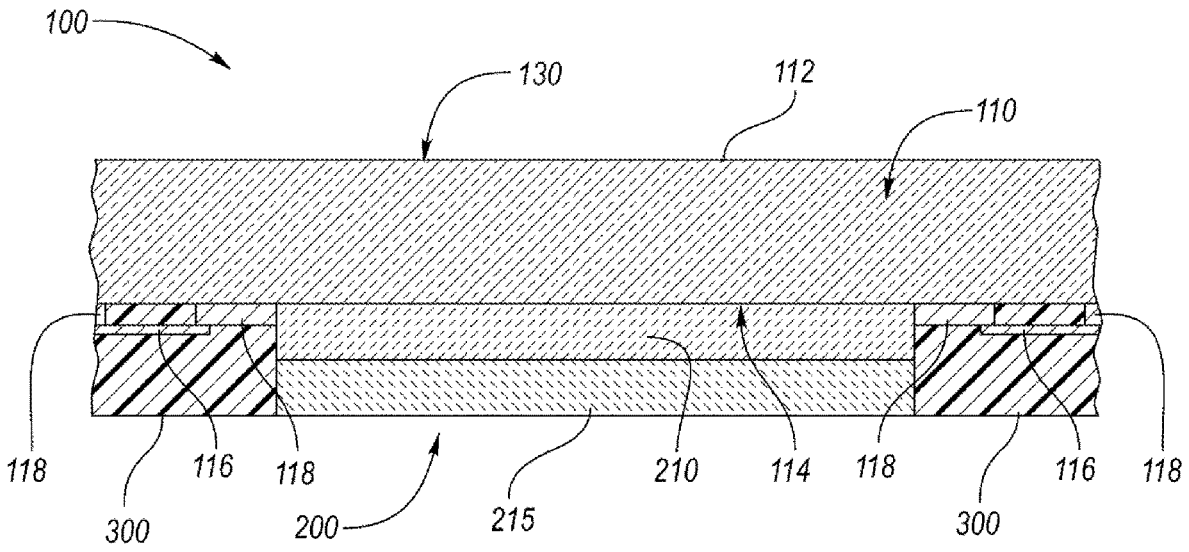
FIG. 3 is a schematic cross-sectional view of a portion A of the electric cooking appliance of FIG. 2, according to an embodiment.

Referring to FIG. 3, a schematic cross-section of a heating element 200 on the glass-ceramic substrate 110 is shown, according to an embodiment. The schematic cross-section of the heating element 200 is a partial view of the cooking appliance 100, depicting a single element as indicated by area A in FIG. 2.

Each heating element 200 has a thermoresistive film layer 210 directly contacting the bottom surface 114 of the glass-ceramic substrate 110, with a protective ceramic coating 215 on the opposite side of the thermoresistive film layer 210 from the bottom surface 114. As shown in FIG. 3, the protective ceramic coating 215 sandwiches the thermoresistive film layer 210 between the protective ceramic coating 215 and the glass-ceramic substrate 110. The protective ceramic coating may be any suitable material, including, but not limited to a ceramic material or a glass ceramic. In some embodiments, the protective ceramic coating 215 may be transparent such that the thermoresistive layer 210 is visible therethrough. Although shown as a single layer protective ceramic coating 215, the protective ceramic coating 215 may include any suitable number of protective and/or insulative layers and/or a combination of layer materials to coat the thermoresistive film layer 210 on the opposite side of the thermoresistive film layer 210 with respect to the glass-ceramic substrate 110.

The thermoresistive film layer 210 generates heat upon application of electricity (i.e., current) to the thermoresistive film layer 210 via the resistivity of the thermoresistive film layer 210. The heat is conducted from the thermoresistive film layer 210 and to the glass-ceramic substrate 110 to heat the cookware on the cooking appliance 100. The thermoresistive film layer 210 may be, in some embodiments, a thin film layer, such that the scale of the thermoresistive film layer is a monolayer having a thickness ranging from a fraction of a nanometer to one nanometer, and up to several micrometers (e.g., up to 50 micrometers). In other embodiments, the thickness of the thermoresistive film layer 210 may be thicker than those defined as thin film layers, and may have thicknesses up to the mm range. The thermoresistive film layer 210 has a thickness of, in some embodiments, 15 nm to 1.75 mm, in other embodiments, 20 nm to 1.5 mm, and in yet other embodiments, 25 nm to 1 mm. In yet other embodiments, the thermoresistive film layer 210 may have a thickness of 25 to 500 nm, in yet other embodiments 25 to 450 nm, and in yet other embodiments, 25 to 425 nm.

In one or more embodiments, the thermoresistive film layer 210 includes a ceramic matrix with a plurality of nanoparticles (e.g., nanotubes, nanoplatelets, or other suitable nanoshape) dispersed therein to provide electrical conduction through and between the heating elements 200, with the nanoparticles providing resistive heating to heat to the cookware via conduction through the glass-ceramic substrate 110. The nanoparticles within the thermoresistive film layer 210 behave as ohmic resistors which generate heat upon application of electricity to the heating element 200, thus providing heat to be conducted through the glass-ceramic substrate 110 to the cookware articles thereon. The nanoparticles may be, in certain embodiments, carbon nanotubes or a graphene nanoparticle (e.g., single layer carbon nanoparticle). In certain embodiments, the nanoparticles may be a hybrid nanoparticle including graphene and one or more of Ag, Ni, or Ga. In one or more embodiments, the hybrid nanoparticle is a hybrid silver and graphene nanoparticle. The one or more of Ag, Ni, or Ga may be loaded into the ceramic matrix by, in some embodiments 0.25 to 2% loading by weight of Ag, Ni, or Ga, in other embodiments 0.4 to 1.75%, and in yet other embodiments 0.5 to 1.5%. The graphene nanoparticles, in certain embodiments, have a loading concentration by weight of 0.05 to 5.5%, in other embodiments 0.075 to 5.25%, and in yet further embodiments, 0.10 to 5.0% in the ceramic matrix. Furthermore, the nanoparticles may be provided in any suitable form, including, but not limited to, nanoplatelets, nanotubes (e.g., CNTs), or nanobeads, such that the nanoparticles are evenly dispersed throughout the ceramic matrix to allow for uniform heating throughout the thermoresistive film layer 210. The nanoparticles may have each an average size (as based on the largest dimension of the particle), in some embodiments, of 2.5 nm to 50 nm, in other embodiments, 4 nm to 35 nm, and in yet other embodiments, 5 nm to 25 nm.

In one or more embodiments, the ceramic matrix of the thermoresistive film layer 210 is formed from a high-temperature stable nanoceramic blended in a high-temperature stable polymer (e.g., the film layer is chemically stable and does not mechanically deform up to, for example, 1,500° C.). The ceramic may be, in some embodiments, zirconia, and the polymer may be, in some embodiments, epoxy. The ceramic matrix thus limits the electron flow through the nanoparticles within the ceramic matrix, and allows the slowed electrons to heat up as they lose energy, thus providing the resistive heating. As such, the nanoparticles provide a dispersed electrical network within the heating element 200 such that, upon application of electrical current, the ceramic matrix causes the nanoparticles to emit heat due to the resistance provided by the ceramic matrix such that the nanoparticles uniformly emit heat to the bottom surface 114 of the glass-ceramic substrate.

In one or more embodiments, the thermoresistive film layer 210 includes graphene nanoplatelets dispersed in a ceramic blend with epoxy and/or a two-system based polymerized polymer, such that the thermoresistive film layer 210 is heated to at least the same temperature as conventional copper wire and steel rod heating elements with less electric power consumption than the conventional copper wire and steel rod heating elements.

Referring again to FIG. 3, the protective ceramic coating 215 may provide a protective physical barrier for the thermoresistive film layer 210 from the bottom side, and also may insulate the bottom side of the heating element 200 to facilitate heat transfer in the direction of the glass-ceramic substrate 110. The protective ceramic coating 215 may be any suitable thickness to protect the thermosensitive coating on the bottom side (with respect to the glass-ceramic substrate 110 being on the top side), and in some embodiments may be 0.1 to 0.5 mm thick, in other embodiments, may be 0.25 to 0.45 mm thick, and in yet other embodiments may be 0.3 to 0.4 mm thick.

The thermoresistive film layer 210 and/or the protective ceramic coating 215 of each heating element 200 may each be independently applied (i.e., the thermoresistive film layer 210 directly on the bottom surface 114; and the protective ceramic coating 215 to the thermoresistive film layer 210) in any suitable manner, such as, but not limited to, screen printing, spraying, injection molding, and the like, and may be applied via masking in one or more steps.

In certain embodiments, as shown in FIG. 3, the electrodes 118 on the bottom surface 114 of the glass-ceramic substrate 110 may include one or more layers of electrically insulative material 300 layered on the electrodes 118 on a side opposite from the glass-ceramic substrate 110, with the electrically insulative material 300 being between adjacent heating elements 200. The electrical connection 116 between the adjacent heating elements 200 and/or to the control panel 120 may be embedded within the electrically insulative material to limit electrical leakage from the connection 116. The electrically insulative material 300 may be similar to, or the same material as, the protective ceramic coating 215, as shown in FIG. 4, or be a different material as shown in FIG. 3.

In one or more embodiments, the electrically insulative material 300 is thermally conductive to allow heat from the heating elements 200 to uniformly heat the glass-ceramic substrate 110 between adjacent activated heating elements 200 to form a more continuously heated cooking area 130. Thus, heat from the heating elements 200 may also spread into the electrically insulative material 300 to aid in heating the cooking area of the glass-ceramic substrate 110, while electrically insulating the components from surrounding areas that were not selectively activated and protecting the electrodes 118 from areas beneath the cooking appliance 100.

The electrically insulative material 300 between adjacent heating elements 200 may have a thermal conductivity in some embodiments, between 0.015 W/mK to 0.5 W/mK, in other embodiments, between 0.020 W/mK to 0.4 W/mK, and in yet other embodiments, between 0.025 W/mK to 0.30 W/mK. The electrically insulative material 300 is electrically insulative such that the electrical current does not travel through the electrically insulative material 300, thus improving control over the selective activation of the specific heating elements 200 desired to control the cooking area. Furthermore, the electrically insulative material 300 covers the electrical connection 116 between the adjacent heating elements 200 (e.g., in some embodiments, the copper connectors).

Figure 4:
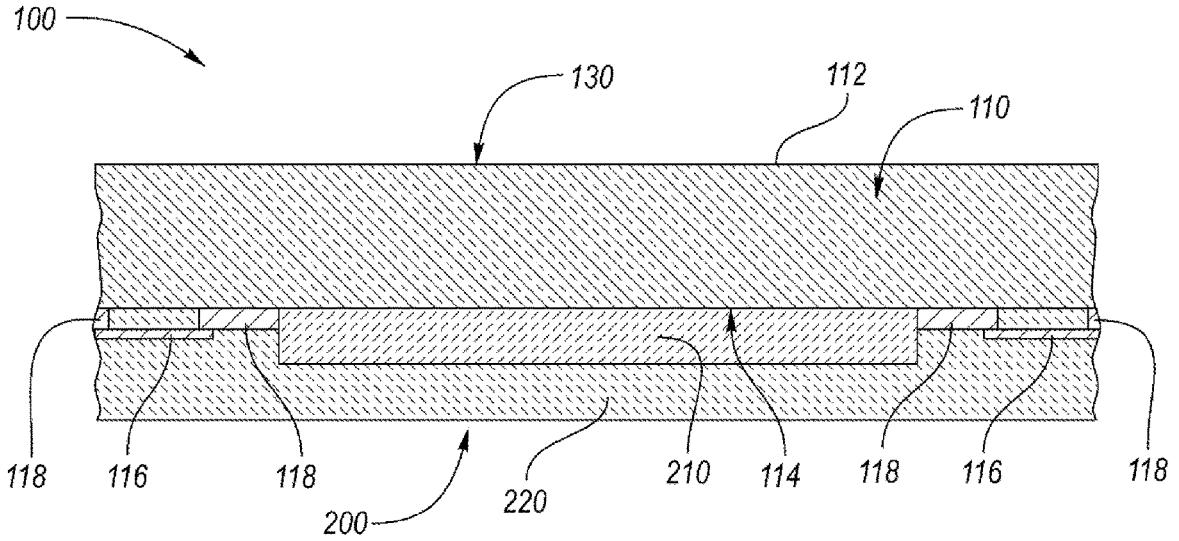
FIG. 4 is a schematic cross-sectional view of a portion A of the electric cooking appliance of FIG. 2, according to another embodiment.

In certain embodiments, referring to FIG. 4, the electrically insulative material 300 and the protective ceramic coating 215 may be a single component layer 220, which overlays the heating elements 200 and their respective electrodes 118 and electrical connection 116 to protect the components on the rear side of the glass-ceramic substrate 110. As such, the layer 220 may be applied in a single step over the applied thermoresistive layer 210 and electrodes 118 after the wiring 116 connects the heating elements 200.

In certain embodiments, the thickness at areas with the thermoresistive layer 210 may be thicker than areas with only the electrodes 118 and the wiring 116. In other embodiments, the layer 220 may be applied such that the components on the back of the glass-ceramic substrate 110 have a uniform thickness across the area of the bottom surface 114.

Referring again to the embodiment of FIG. 3, the protective ceramic coating 215 and the electrically insulative material 300 may be applied in separate steps (e.g., via screen printing or masking) such that the heating elements are formed with the prior to application of the electrically insulative material 300 between heating elements 200 after application of the electrodes 118 and placement of the electrical wiring 116 (e.g., via a different mask).

According to one or more embodiments, a cooking appliance with an electric radiant or non-radiant (e.g., induction) cooktop is provided. The cooking appliance includes a glass-ceramic substrate with a top surface for receiving cookware thereon for heating. The bottom surface of the glass-ceramic substrate is coated with a plurality of discrete thermoresistive heating elements which are electrically connected to each other and to a power supply. The thermoresistive heating elements include nanoparticles loaded in a ceramic matrix such that, upon application of an electric current, the nanoparticles emit heat due to the resistive properties of the ceramic matrix on the conduction through the nanoparticles. Based on the electrical connection, the thermoresistive heating elements may be selectively activated to adjust the cooking area of the glass-ceramic substrate. Furthermore, the cooking appliance may include a protective layer and/or thermally conductive electrically insulative material on the surface of the thermoresistive layer opposite the glass-ceramic substrate and between adjacent thermoresistive heating elements to improve the uniform heating of the glass-ceramic substrate.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electric cooking appliance, comprising:

a glass-ceramic substrate having a top surface for supporting cookware for heating thereon, and a bottom surface opposite the top surface; and a plurality of thermoresistive heating elements disposed and spaced apart on the bottom surface of the glass-ceramic substrate, each of the plurality of thermoresistive heating elements include graphene nanoparticles embedded in a ceramic matrix for generating heat upon application of electric current to the respective thermoresistive heating element, and each thermoresistive heating element is a layered composite including a protective ceramic layer on an opposite side of the thermoresistive layer from the glass-ceramic substrate, and each thermoresistive heating element includes a corresponding pair of silver electrodes in contact with the bottom surface, and the silver electrodes include an electrically insulative material thereon on a side opposite from the bottom surface, wherein each thermoresistive heating element is electrically connected to a power supply such that one or more of the plurality of thermoresistive heating elements are selectively activated to receive electric current to heat localized areas of the glass-ceramic substrate.

2. The electric cooking appliance of claim 1, wherein two or more of the plurality of thermoresistive heating elements are interconnected and connected to the power supply such that predefined groups of thermoresistive heating elements of the plurality of heating elements may be selectively activated to receive the electric current.

3. The electric cooking appliance of claim 1, further comprising electrically insulative material positioned between adjacent heating elements of the plurality of thermoresistive heating elements, the electrically insulative material having a thermal conductivity of 0.015 W/mK to 0.5 W/mK.

4. The electric cooking appliance of claim 1, wherein each of the thermoresistive heating elements is a hybrid material further including Ag, Ni, or Ga nanoparticles, or combinations thereof.

5. The electric cooking appliance of claim 1, wherein the ceramic matrix is a blend of zirconia and one or more of an epoxy and a polyurethane.

6. The electric cooking appliance of claim 1, wherein each of the thermoresistive heating elements has a thickness of 100 μm to 2 mm.

7. The electric cooking appliance of claim 1, wherein each thermoresistive heating element includes a thermoresistive film layer with the graphene nanoparticles, the thermoresistive film layer having a thickness of 15 nm to 1.75 mm.

8. The electric cooking appliance of claim 1, wherein the graphene nanoparticles have an average particle size of 2.5 nm to 50 nm.

9. The electric cooking appliance of claim 1, wherein the protective ceramic layer has a thickness of 0.1 to 0.5 mm.

10. An electric cooking appliance, comprising:

a glass-ceramic substrate having a top surface for supporting cookware for heating thereon, and a bottom surface opposite the top surface; and a plurality of thermoresistive heating elements disposed and spaced apart on the bottom surface of the glass-ceramic substrate, each of the plurality of thermoresistive heating elements including a thermoresistive layer of hybrid silver-graphene nanoplatelets in a ceramic matrix in contact with the bottom surface, and each of the plurality of thermoresistive heating elements is a layered composite including a protective ceramic layer on an opposite side of the thermoresistive layer from the glass-ceramic substrate, and each of the plurality of thermoresistive heating elements includes a corresponding pair of silver electrodes on opposite sides of the respective heating element in contact with the bottom surface, and the silver electrodes include an electrically insulative material thereon on a side of each electrode opposite from the bottom surface, wherein each thermoresistive heating element is electrically connected to at least one of another thermoresistive heating element and a power supply such that one or more of the plurality of thermoresistive heating elements are selectively activated to receive electric current to heat localized areas of the glass-ceramic substrate.

11. The electric cooking appliance of claim 10, wherein each of the thermoresistive heating elements includes a corresponding pair of silver electrodes for arrangement with electrical wiring to electrically connect the thermoresistive heating elements.

12. The electric cooking appliance of claim 10, wherein the ceramic matrix is a blend of zirconia and an epoxy.

13. The electric cooking appliance of claim 10, wherein each thermoresistive heating element is independently activatable for selective activation to form a customized cooking area.

14. The electric cooking appliance of claim 10, wherein the electrically insulative material and the protective ceramic layer is the same material.

15. An electric cooking appliance, comprising:

a glass-ceramic substrate having a top surface for supporting cookware for heating thereon, and a bottom surface opposite the top surface;

a plurality of thermoresistive heating elements disposed and spaced apart on the bottom surface of the glass-ceramic substrate, each of the plurality of thermoresistive heating elements include graphene nanoparticles embedded in a ceramic matrix for generating heat upon application of electric current to the respective thermoresistive heating element, and each thermoresistive heating element is a layered composite including a protective ceramic layer on an opposite side of the thermoresistive layer from the glass-ceramic substrate, and each thermoresistive heating element includes a corresponding pair of silver electrodes on opposite sides of the respective heating element in contact with the bottom surface; and an electrically insulative layer positioned between adjacent thermoresistive heating elements of the plurality of thermoresistive heating elements and on an opposite side of the plurality of thermoresistive heating elements from the glass-ceramic substrate, the electrically insulative layer positioned on the silver electrodes, wherein each thermoresistive heating element is electrically connected to at least one of another thermoresistive heating element and a power supply such that one or more of the plurality of thermoresistive heating elements are selectively activated to receive electric current to heat localized areas of the glass-ceramic substrate.

16. The electric cooking appliance of claim 15, wherein each of the plurality of thermoresistive heating elements includes the protective ceramic layer on a surface of the respective thermoresistive heating element opposite from the glass-ceramic substrate.

17. The electric cooking appliance of claim 15, wherein each of the plurality of thermoresistive heating elements further includes nanoparticles of Ag, Ni, Ga, or combinations thereof in the ceramic matrix.

18. The electric cooking appliance of claim 17, wherein the nanoparticles of Ag, Ni, Ga, or combinations thereof are loaded into the ceramic matrix by 0.25 to 2% loading by weight.

* * * * *